US007757500B2

(12) United States Patent
Hawkes et al.

(10) Patent No.: US 7,757,500 B2
(45) Date of Patent: Jul. 20, 2010

(54) ICE MANAGEMENT APPARATUS

(75) Inventors: Richard B. Hawkes, Bethlehem, PA (US); Edward V. Twiggar, III, Wind Gap, PA (US)

(73) Assignee: Follett Corporation, Easton, PA (US)

( * ) Notice: Subject to any disclaimer, the term of this patent is extended or adjusted under 35 U.S.C. 154(b) by 451 days.

(21) Appl. No.: 11/750,551

(22) Filed: May 18, 2007

(65) Prior Publication Data

US 2008/0282711 A1 Nov. 20, 2008

(51) Int. Cl.
*F25C 5/18* (2006.01)

(52) U.S. Cl. ..... 62/137; 62/344; 62/354

(58) Field of Classification Search ..... 62/137, 62/344, 354; 251/368; 340/617
See application file for complete search history.

(56) References Cited

U.S. PATENT DOCUMENTS

| | | | | |
|---|---|---|---|---|
| 3,126,719 | A | 3/1964 | Swatsick | |
| 3,371,505 | A | 3/1968 | Raver et al. | |
| 3,581,768 | A | 6/1971 | Conti | |
| 3,771,560 | A | 11/1973 | Conti et al. | |
| 3,877,241 | A * | 4/1975 | Wade | 62/137 |
| 4,055,280 | A | 10/1977 | Kohl et al. | |
| 4,104,889 | A * | 8/1978 | Hoenisch | 62/137 |
| 4,662,182 | A * | 5/1987 | Tsukiyama et al. | 62/137 |
| 4,922,724 | A * | 5/1990 | Grayson et al. | 62/135 |
| 5,211,030 | A | 5/1993 | Jameson | |
| 5,279,264 | A * | 1/1994 | Simmons et al. | 123/41.1 |
| 5,299,427 | A * | 4/1994 | Miller et al. | 62/66 |
| 5,354,152 | A * | 10/1994 | Reinhardt et al. | 406/3 |
| 5,542,573 | A | 8/1996 | Frantz | |
| 5,887,758 | A | 3/1999 | Hawkes et al. | |
| 6,134,908 | A | 10/2000 | Brunner et al. | |
| 6,167,711 | B1 * | 1/2001 | Slattery et al. | 62/78 |
| 6,561,691 | B1 * | 5/2003 | McCann et al. | 366/299 |
| 6,685,053 | B2 | 2/2004 | Hawkes et al. | |
| 6,860,408 | B2 | 3/2005 | Hawkes | |
| 6,952,935 | B2 | 10/2005 | Vorosmarti et al. | |
| 7,096,686 | B2 | 8/2006 | Brunner et al. | |
| 7,137,271 | B2 | 11/2006 | Hawkes et al. | |

* cited by examiner

*Primary Examiner*—William E Tapolcai
(74) *Attorney, Agent, or Firm*—Paul & Paul

(57) ABSTRACT

An ice making, and delivery apparatus for making and delivering ice to different ones of a plurality of receptacle units is provided, in which ice delivered via a conduit to a diverter valve mechanism, is diverted from alignment with one ice discharge line to another, depending upon sensors in ice receptacles recognizing a level of build-up of ice in any given receptacle, for computer control of a gearmotor for moving the diverter valve from one position to another. Various controls are provided for preventing ice build-up, and for operating the diverter valve during a "dwell" period of ice movement in the conduit, as distinguished from a "push" period of ice movement in the conduit to the diverter valve. A force multiplication technique is employed for moving the diverter valve notwithstanding the presence of ice therein.

9 Claims, 7 Drawing Sheets

ICE MANAGEMENT APPARATUS

BACKGROUND OF THE INVENTION

In ice making and handling systems, it is known to produce ice by employing a refrigeration cycle, which makes ice by freezing water, and to deliver the ice from a site of its manufacture to an ice receptacle from which the ice may be accessed and used.

It is also known that the manufacture of ice can be accomplished by the use of an auger which scrapes ice that is formed on an inner wall of a cylinder, and moves the ice toward one end of the auger by which it is compressed and delivered as nuggets into a conduit, through which it is pushed to an ice storage receptacle. In the receptacle, the ice can be retained until it is desired to access ice for use, or the receptacle can be one in which the ice is used to cool other substances, such as drinking liquids, for example.

An example of an auger-type ice maker and ice compression apparatus is that disclosed in U.S. Pat. No. 6,134,908; an example of one type of ice receptacle is that disclosed in U.S. Pat. No. 5,887,758; another example of an ice receptacle or retaining unit is that disclosed in U.S. Pat. No. 7,137,271; yet another such example is that disclosed in U.S. Pat. No. 5,211,030; a further example of an ice receptacle is that disclosed in U.S. Pat. No. 5,542,573; yet other examples of ice making and delivery apparatus are disclosed in U.S. Pat. No. 7,096,686, U.S. Pat. Nos. 6,860,408; 6,952,935 and 6,685,053; other examples of ice delivery systems are those in which a given delivery line is caused to divert ice among different receptacles as are disclosed in U.S. Pat. Nos. 3,581,768, 3,771,560 and 4,055,280.

The disclosures of each of the above-identified patents are herewith incorporated herein by reference.

THE PRESENT INVENTION

The present invention is directed to an ice diverter valve and its system, for use with an ice making and delivery apparatus, by which ice from a single source can be diverted to any one of a plurality of receptacles in a controlled fashion, and even while the ice making machine continues to operate and under a high level of force multiplication, to effectively divert ice from one ice discharge line to another ice discharge line, notwithstanding the presence of ice at the location of valve movement.

The controls in accordance with this invention include level sensors in the ice receptacles, controls for the motor that drives the ice diverter valve from one position to another while the valve changes the position of the diverter valve, shut-down controls for recognizing ice back-up in an ice delivery conduit, and controls for recognizing a dwell period that occurs between periods of a motor driven auger pushing ice into an ice conduit, for operating an ice diverter valve during such a dwell period.

In some instances motor-driven vanes are used, in connection with magnetic switches.

The various controls include a microcontroller or computer system. An operator control mechanism is also provided, to override automatic controls.

SUMMARY OF INVENTION

The present invention is directed to an ice making and delivery apparatus for delivering ice to one of a plurality of receptacle units, by the use of a diverter valve system that is operated during a dwell period of delivery of ice from an ice maker into a conduit by sensing such a dwell period and controlling the activation of an ice diverter valve, accordingly.

The present invention is also directed to a diverter valve connected to an ice delivery conduit, and means activating the valve under force multiplication by sensing a predetermined level of ice build-up in a given unit and then activating a force multiplication means to divert ice flow through the valve from one valve discharge line to another valve discharge line.

The present invention is also directed to an ice diverter valve system located in a water-tight housing, with the valve being operated from outside the housing.

Accordingly, it is one object of this invention to provide an ice making and delivery apparatus, in which the ice is delivered into a conduit during an ice discharge period, followed by a dwell period, and wherein the dwell period is detected for operating a valve connected to the conduit to divert ice passing through a valve mechanism from one valve discharge line to another valve discharge line during such a dwell period.

It is a further object of this invention to accomplish the above object wherein each valve discharge line feeds a separate ice receptacle unit.

It is yet another object of this invention to accomplish the above objects, wherein a sensing means is provided for sensing the build-up of ice in any given ice receptacle unit.

It is a further object of this invention to accomplish the above objects by means of computer operation for controlling the same.

It is yet another object of this invention to accomplish the above objects, wherein an operator override system is provided for manual override and control of the operation.

It is yet another object of this invention to accomplish the above objects, wherein a motor drive means is provided for operating the ice maker, and wherein ice backing-up in an ice delivery conduit is detected when such occurs, and the motor drive for the ice maker is shut down in response thereto.

It is yet another object of this invention to accomplish the above objects, wherein a force multiplication apparatus is provided for controlling the diverter valve.

Another object of this invention is to provide a diverter valve for controlling the flow of ice from a conduit that delivers ice to the valve, to different ice discharge lines coming from the valve.

It is another object of this invention to provide a diverter valve system, in which the valve is contained within a water-tight housing, and wherein the valve is operated from outside the housing.

Other objects and advantages of the present invention will be readily apparent upon a reading of the following brief descriptions of the drawing figures, detailed descriptions of the preferred embodiments and the appended claims.

BRIEF DESCRIPTIONS OF THE DRAWING FIGURES

DETAILED DESCRIPTIONS OF THE PREFERRED EMBODIMENTS

Figure 1:
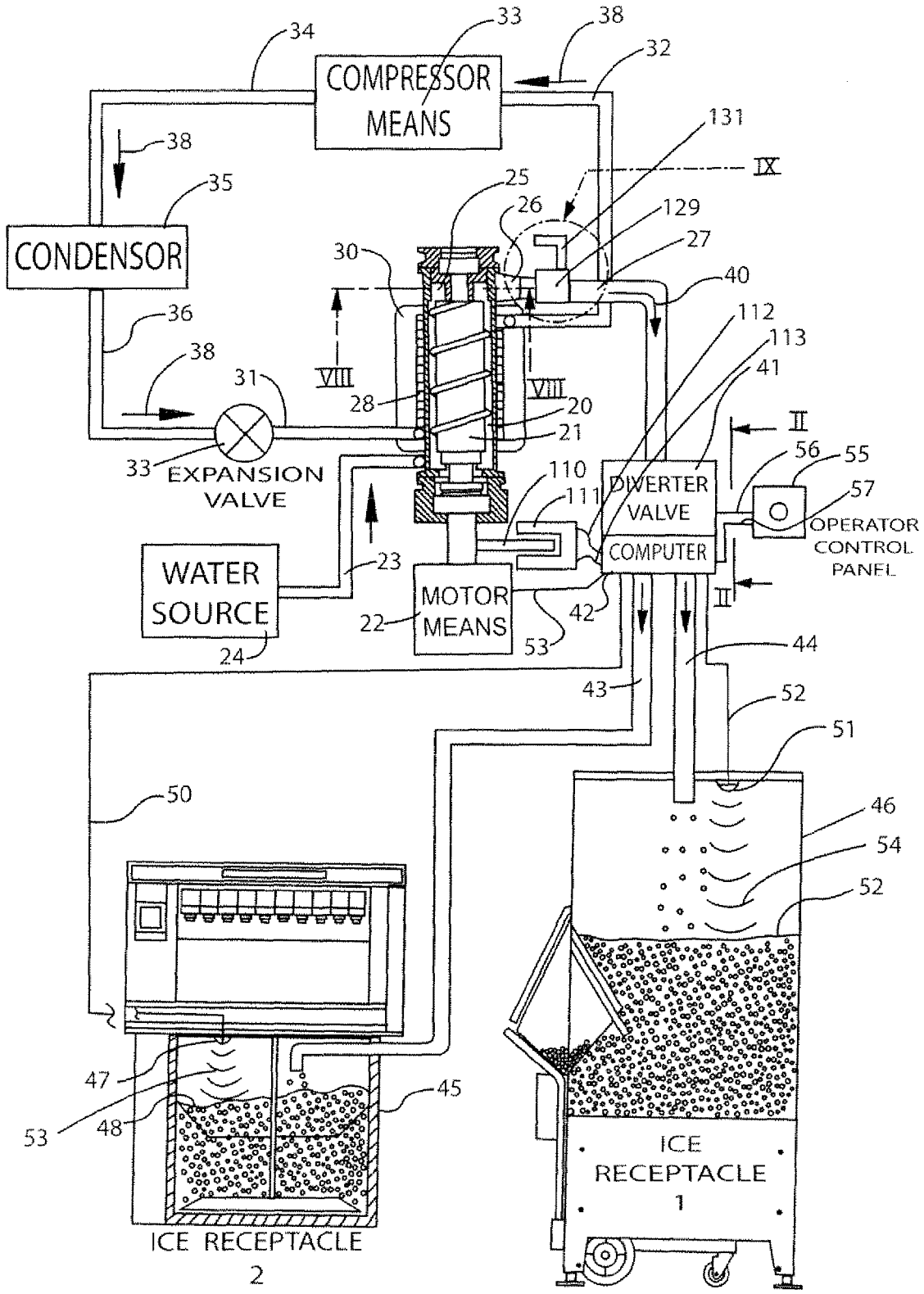
FIG. 1 is an overall schematic illustration of an ice making apparatus for feeding ice to a delivery conduit, then through a computer controlled diverter valve device, to one of a plurality of ice receptacles, also illustrating an operator override control panel.
Figure 2:
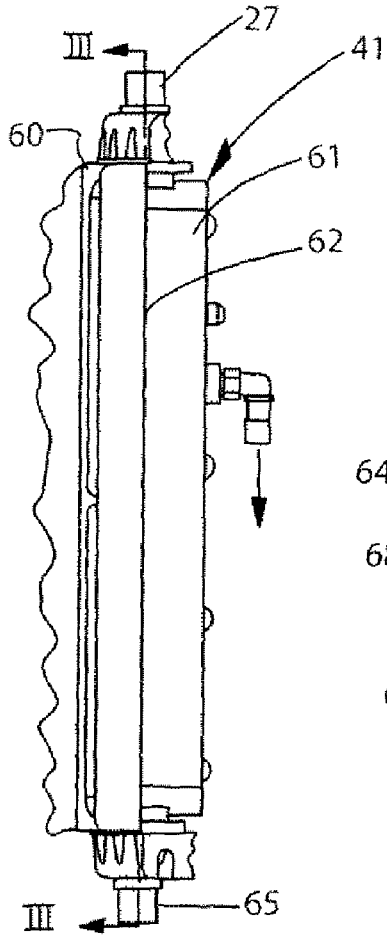
FIG. 2 is an enlarged fragmentary side elevational view of the diverter valve housing of FIG. 1, taken generally along the line II-II of FIG. 1, with a drain line being illustrated from the diverter valve housing, it being understood that the apparatus of FIG. 2 would normally be disposed rotated 90° to the right, with the drain line beneath the lower end of the housing.

Referring now to the drawings in detail, reference is first made to FIG. 1, wherein an ice-forming chamber 20 is illustrated, having a rotatable auger 21 therein, driven for rotation by means of a motor means 22, whereby water that is delivered into the chamber 20 via delivery line 23 from a water source 24 is subjected to a refrigeration system that produces shavings of ice that are compressed at an upper end 25 thereof in an ice compression nozzle 26, to compress the ice into discrete nuggets before they enter a generally flexible ice delivery conduit or tube 27, reinforced by some means such as, for example, spiral wound wire, preferably embedded therein, braided reinforcement or other reinforcement. The water that produces the freezing inside the cylindrical chamber 20 is subjected to a conventional refrigeration cycle whereby refrigerant is delivered to a coil 28 inside a refrigerant zone 30, from a line 31 that, in turn, has refrigerant that is delivered from line 32 through a compressor 33, and via a line 34 to a condenser 35, and then via a line 36 to an expansion valve 37, forming a loop as indicated by the arrows 38.

Ice that is delivered into the ice-receiving conduit 27 passes therealong in the direction of the arrow 40, to a diverter valve system 41 that is, in turn, controlled by a computer or microcontroller 42. The diverter valve 41 system diverts ice passing through the diverter valve system into one of a plurality of diverter valve discharge lines, such as the two such lines 43, 44.

Line 43 delivers any ice passing therethrough into an ice receptacle 45, constructed to be similar to that shown in U.S. Pat. No. 5,542,573, or in any other form.

Diverter valve discharge line 44 delivers ice into an ice receptacle 46, that, in turn, is constructed for example like that shown in any of U.S. Pat. Nos. 5,211,310 or 5,887,758, or constructed in any other manner.

Lines 43 and 44 for carrying nuggets from the diverter valve to the ice receptacle units can likewise be comprised of flexible tubing, reinforced with some means, such as spiral wound wire embedded therein with or without braided reinforcement or other reinforcement.

Ice receptacle 2, identified by number 45 is provided with a sensor 47, preferably of the ultrasonic type, for sensing a level 48 of build-up of ice in receptacle 45, and, in response to a generally predetermined such level, will recognize that ice receptacle 45 is approaching a maximum fill level, and will send a signal via signal line 50, to the computer 42, to actuate the diverter valve system 41, to divert ice into another ice receptacle, such as ice receptacle 1 identified by number 46.

Ice receptacle 46 similarly is provided with a sensor, preferably also in the form of an ultrasonic sensor 51, for sending a signal responsive to a level 52 of ice build-up in receptacle 46, such that when the level 52 reaches a likewise preferably predetermined maximum fill level, the sensor 51 will send the signal to the computer 42 via signal line 52, to actuate the diverter valve system, to either resume the sending of ice to receptacle 45, or to shut down the manufacture of ice, via control line 53 for controlling the motor means 22.

It will be understood that the sensors 47, 51 can be any other form of sensor, although ultrasonic sensing is preferred. When ultrasonic sensing is used, it will generate ultrasonic waves 53, 54 that are delivered downwardly, as shown in FIG. 1, from an ultrasonic generator that forms part of the ultrasonic sensors 47, 51, to echo off the built-up level of ice 48, 52 formed in the respective retaining units 45, 46. The sensor system for sensing the level of build-up ice within a retaining unit can, as an alternative to the ultrasonic units described above, be mechanical switches or other sensors, activating mechanical control lines that, in turn, operate the computer 42. Even further alternatives of sensing systems such as infrared light beams or temperature sensing devices like thermostats or the like, can alternatively be used to sense the built-up level of ice in a retaining unit, as can other types of sensing means likewise, alternatively, be used. In lieu of control lines 50, 52 from the ultrasonic sensing devices, alternatively, wireless signal communication from sensing devices to the computer could be used for control, for example of the transmitter/receiver type. Such may be especially desirable in installations where the running of hardwired connections may be difficult, or less desirable.

Also, in FIG. 1, an operator control panel 55 is provided, for overriding the automatic operation of the system illustrated in FIG. 1, to control the operation of the diverter valve system via line 56, and/or to override the computer operation of the system of FIG. 1, via control line 57. In lieu of hardwired connections 56, 57, between the operator control panel 55 and one or both of the diverter valve 41 and computer 42, wireless connections could be used. For example, where the operator control panel 55 is desired to be somewhat more remotely placed relative to the rest of the system, wireless connections, for example, of the transmitter/receiver type may alternatively be used.

Figure 5:
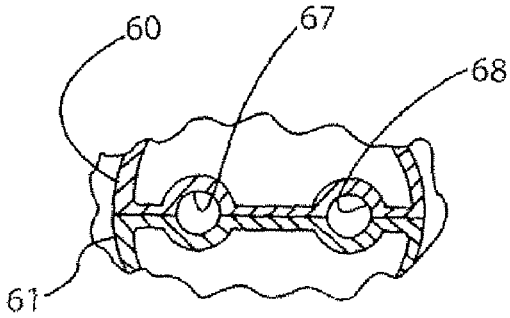
FIG. 5 is a fragmentary transverse sectional view, taken through a portion of the diverter valve housing and a pair of valve discharge lines, with the illustration of FIG. 5 being taken generally along line V-V of FIG. 3.

With reference now to FIGS. 2-5, it will be seen that the diverter valve system 41 is comprised of preferably molded thermoplastic upper and lower housing components 60 and 61 that mate together along a parting line 62, with the upper and lower housing parts being connected together in a water-tight scaled fashion by suitable connectors (not shown), preferably with a gasket between the components 60, 61. Ice delivery conduit 27 delivers ice into a valve inlet conduit 63, through the diverter valve itself 64, to then be delivered to one of a pair of valve discharge lines 65, 66, via molded valve discharge ducts 67, 68, respectively. The discharge ducts 67, 68 are comprised of upper and lower molded portions of the housing 60, 61, as shown in FIG. 5, for example, for subsequent delivery of ice via respective ice discharge lines 65, 66, as shown by the directional arrows 70, 71, to one of the ice receptacles 45, 46.

The couplings for the conduits or ducts 27, 43, 44, at each end are designed to minimize flow path obstructions and allow for easy and reliable ice transport tube connections to the various distribution system elements, which elements include the ice making apparatus, the diverter valve, and the receptacles. Such couplings will preferably comprise in each instance, a thin-walled stainless steel tube with a flow path lead-in, inserted in a plastic molded coupling that is designed to fit and seal within a molded coupling housing. The ice transport tubes or conduits 27, 43 and 44, while being flexible and reinforced, can also include a braided reinforcement, that may or may not be used with the spiral wire reinforcement described above, and which will preferably be capable of being applied in situations where there are tight radius bends, without inner diameter distortion and/or flow path restriction.

Figure 6:
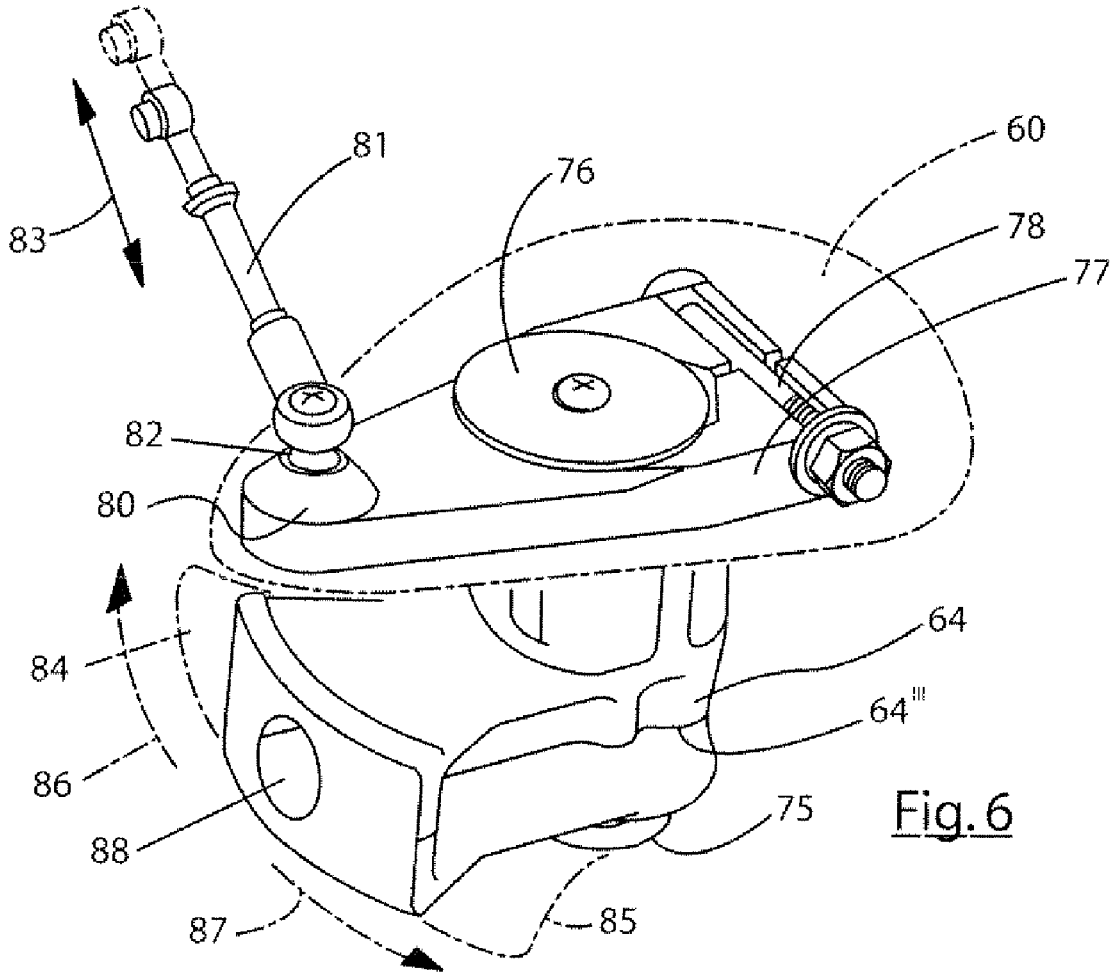
FIG. 6 is a top perspective view of the diverter valve mechanism of this invention, with a drive lever for the same extending through a portion of a diverter valve housing (shown in phantom), and with the lever being capable of being driven back and forth by means of a connecting rod pivotally connected thereto.
Figure 6A:
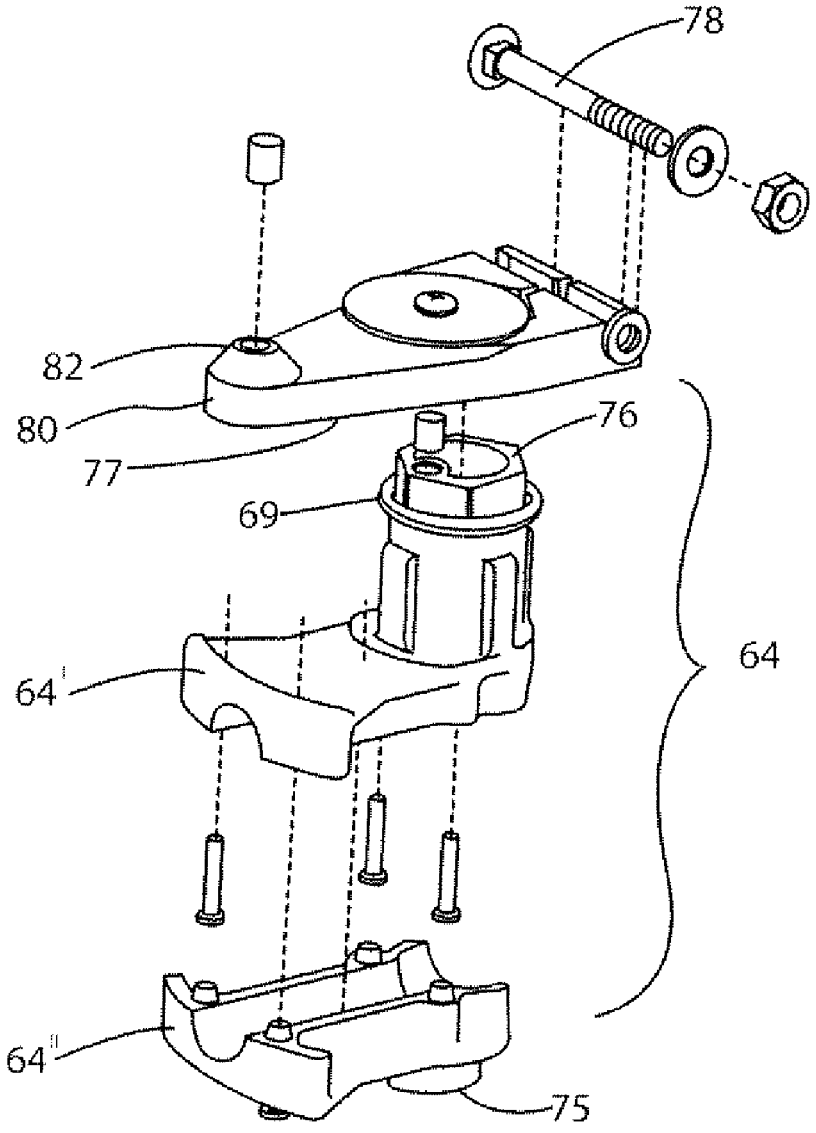
FIG. 6A is an exploded, perspective view of the diverter valve mechanism of this invention illustrated in FIG. 6, wherein the various components, including the upper and lower molded parts of the diverter valve itself and the yoke by which it is pivotally driven, are more clearly illustrated.
Figure 7:
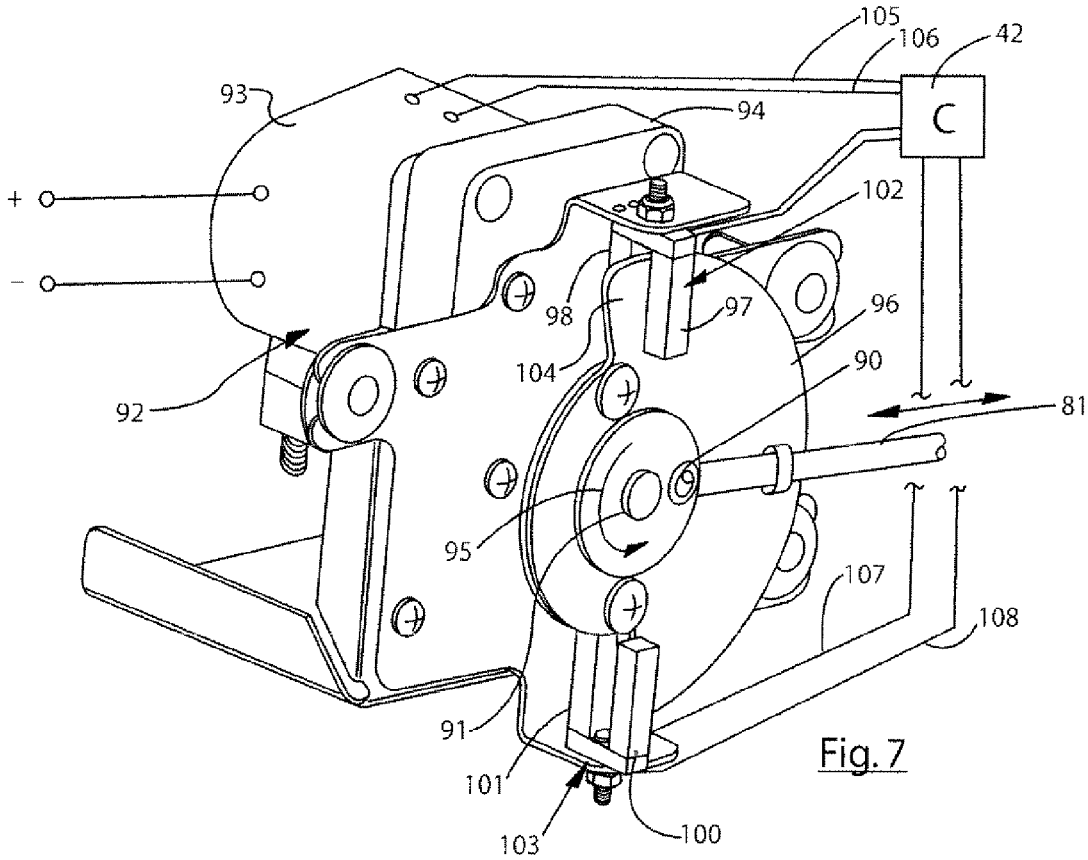
FIG. 7 is a perspective view of a drive gearmotor for driving the connecting rod illustrated in FIG. 6 and magnetic switches for sensing the position of the diverter valve relative to the alignment of the diverter valve with one of a plurality of valve discharge lines, and with control means for the same also being illustrated.

With reference now to FIGS. 6 and 7, the operation of diverter valve 64 within the diverter valve housing 60 will now be described.

Figure 3:
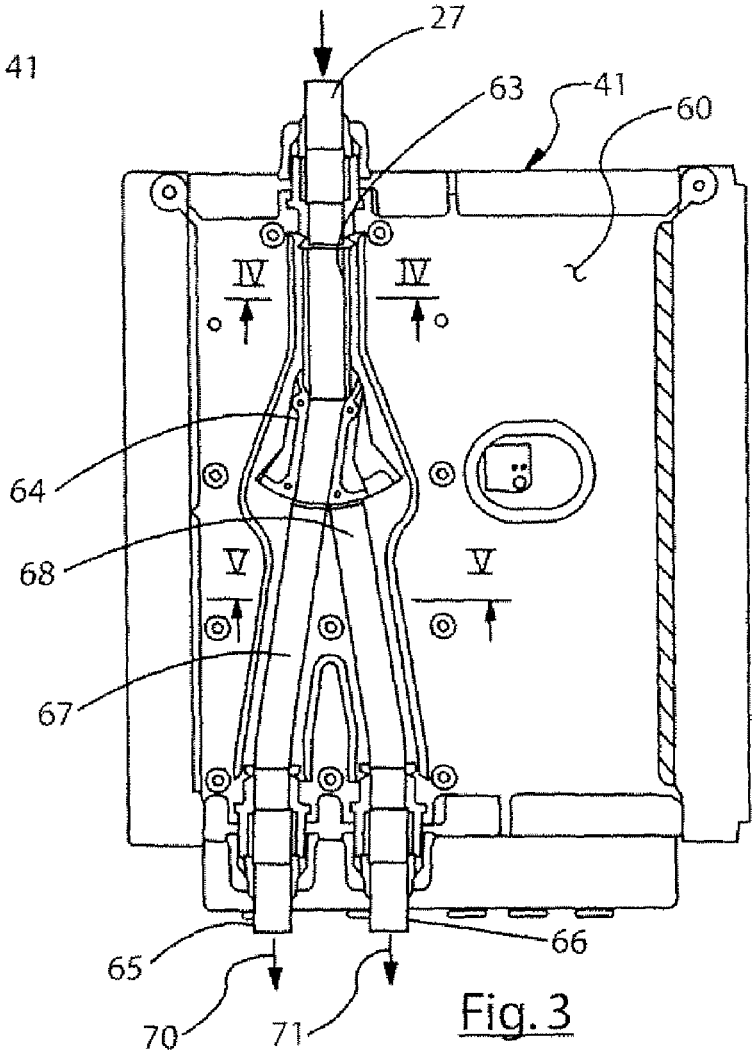
FIG. 3 is an illustration of the housing for the diverter valve, taken generally along the line III-III of FIG. 2, along the parting plane of two halves of the diverter valve housing of FIG. 2.
Figure 4:
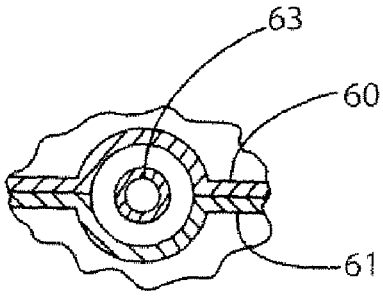
FIG. 4 is a fragmentary transverse sectional view, taken through a portion of the inlet to the diverter valve, generally along the line IV-IV of FIG. 3.

The diverter valve itself, 64, is comprised of upper and lower molded thermoplastic parts 64' and 64", sealed together along a parting line 64'", and is pivotally mounted relative to lower and upper housing components 61, 60, respectively at 75, 76, inside the housing 60, and an upper end 76 thereof extends through the housing wall 60, through a suitable water-tight seal 69 of the "O" ring type. A yoke 77 is clamped to the upper end 76 of the diverter valve, via a suitable threaded bolt clamping device 78, or in some other manner such that the yoke 77 has a radial extension 80 thereof driven by an adjustable connecting rod 81, pivotally connected to the lever extension 80 of the yoke 77 via a suitable pivotal connection 82. It will thus be seen that, as the connecting rod 81 is moved backward and forward in the direction of the double headed arrow 83, the diverter valve 64 can likewise be moved from the full line position therefore shown in FIG. 6, to either of the phantom positions 84, 85 shown therefore, such movement of the diverter valve 64 being arcuate as indicated by the respective arrows 86, 87, as shown. Depending upon the position of the diverter valve 64, the discharge end 88 of the diverter valve will divert ice into one or the other of the diverter valve discharge ducts 67, 68, to deliver ice to a respectively associated diverter valve discharge line 65, 66, as shown in FIG. 3.

The connecting rod 81 is driven from an eccentric crank 90 that is radially offset from a gearmotor driven shaft 91 of a gearmotor 92. The gearmotor 92 comprises a motor 93 and a transmission system 94, for creating a force multiplication to step down the speed of the motor 93, to produce the motor torque needed to drive the diverter valve 64 from one position to another as described above with respect to FIG. 6, as the shaft 91 of the gearmotor 92 is rotated in the direction of the arrow 95 illustrated in FIG. 7.

The shaft 91 carries a vane 96 for rotation therewith.

The vane 96 is of such metal construction that it operates in connection with the poles 97, 98, 100, 101 of magnetic switches 102 and 103, such that when the upper end 104 of the vane 96 is disposed between the poles 97, 98 of magnetic switch 102, for example, it is sensed that the diverter valve 64 (also referred to as a paddle) has gone through a 180° throw, causing the magnetic switch 102 to be actuated, and to tell the computer 42 to shut off the motor 93, via control lines 105, 106, because the valve or paddle 64 is in one of the two positions such that its discharge end 88 is aligned with one of the diverter valve discharge ducts 67, 68. When a sensor, such as 47 or 51 thereafter senses build-up of ice in one of the receptacles 45, 46, to a full level, the sensors, operating via sensor lines 50 or 52, will then tell the computer 42 to re-start the motor 93, to move the shaft 91 thereof through another 180° arc, to either push or pull the connecting rod 81 in an opposite direction to its previous movement, until the forward end 104 of the vane is disposed between the poles 100, 101 of the magnetic switch 103, at which time the signal delivered to the computer 42 via electric lines 107, 108, will again tell the computer 42 that the diverter valve or paddle 64 is now in position, fully aligned with the other of the diverter valve discharge ducts 67 or 68, to again shut down the operation of the motor 93. Thus, the crank 90, when driven 180°, gives the lever enough angular displacement to produce a complete divert for the valve or paddle 64. At the two ends of the crank stroke, significant forces pushing and/or pulling the connecting rod occur. This force multiplication imparted to the connecting rod and lever reduces the motor torque needed to drive the diverter valve or paddle 64 through ice that may be in the vicinity of the diverter valve discharge opening 88. The gearmotor, crank and connecting rod system give the assembly a low cost, high force, accurate positioning of the diverter valve or paddle, to enable it to rapidly chop through the ice stream that may be continuously moving.

Figure 8:
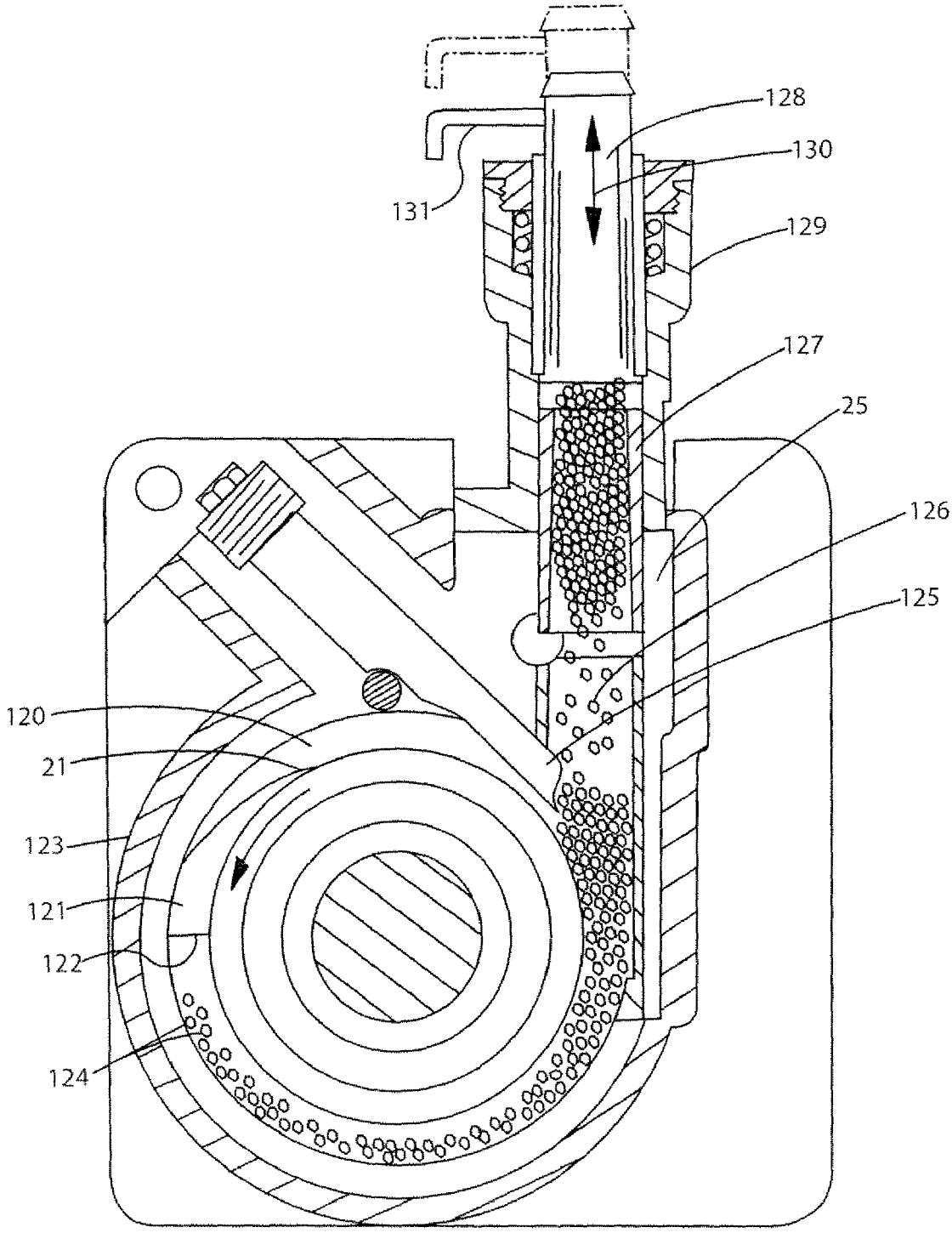
FIG. 8 is a cross-sectional view, taken through the discharge end of an ice-making auger illustrated in FIG. 1, generally along the line VIII-VIII of FIG. 1, and showing the mechanism by which ice back-up in the conduit which receives ice from the auger can operate to compress a spring, for operating a magnetic switch for shutting down the ice-making operation.

With reference now to FIGS. 1 and 8, there will now be described a preferred feature of this invention, such that diverter valve 64 will preferably only be operated by the gearmotor 92 controlled by the computer 42 during a dwell period of discharge of ice from the auger, in that, in the embodiment shown in FIG. 8, there will alternatively be "push" periods when ice is being pushed into the conduit 27, followed by "dwell" period when ice is not being pushed into the conduit 27.

The auger 21 has a flange 120 that carries a paddle 121. The paddle 121, in turn has a "push" surface 122, such that, as the auger rotates in the direction of the arrow 123, the "push" surface pushes ice particles 124 ahead of the surface 122, such that they are delivered past breakup device 125, through an expansion zone 126, through a compression nozzle 127, through a coupling 128 that is vertically moveable as shown by the double-headed arrow 130, between the full line position therefore shown in FIG. 8 and the phantom line position shown in FIG. 8. The coupling 128 carries an "L" shaped flag 131, likewise moveable between the full line and phantom positions shown therefore. It will thus be seen that as the push surface 122 pushes ice ahead of it, through approximately a 180° stroke, such creates an ice "push" period of the rotating movement of the auger. This "push" period is followed by a "dwell" period after the push surface 122 passes the ice breakup member 125, during which, while the auger is rotating, it is not actively pushing ice into the conduit 27.

The "dwell"/"push" periods of operation of the auger to push ice into conduit 27 is controlled by means of a vane 110 carried for rotation on the shaft of the motor means as shown in FIG. 1, the vane being arranged in sequence with the push surface 122 of the auger shown in FIG. 8, such that when the presence of the vane 110 between the poles of the magnetic switch 111 occurs, such tells the computer 42 that the push cycle has passed, and that the push surface 122 is now in a "dwell" period such that the computer 42 will recognize that in this "dwell" period, the operation of the gearmotor 93 to move the diverter valve or paddle 64, once again, so that its discharge opening 88 is aligned with a different one of the discharge ducts 67, 68, for diverting ice to a different receptacle 45, 46 can now occur if the same is called for by one of the sensors 47, 51.

Figure 9:
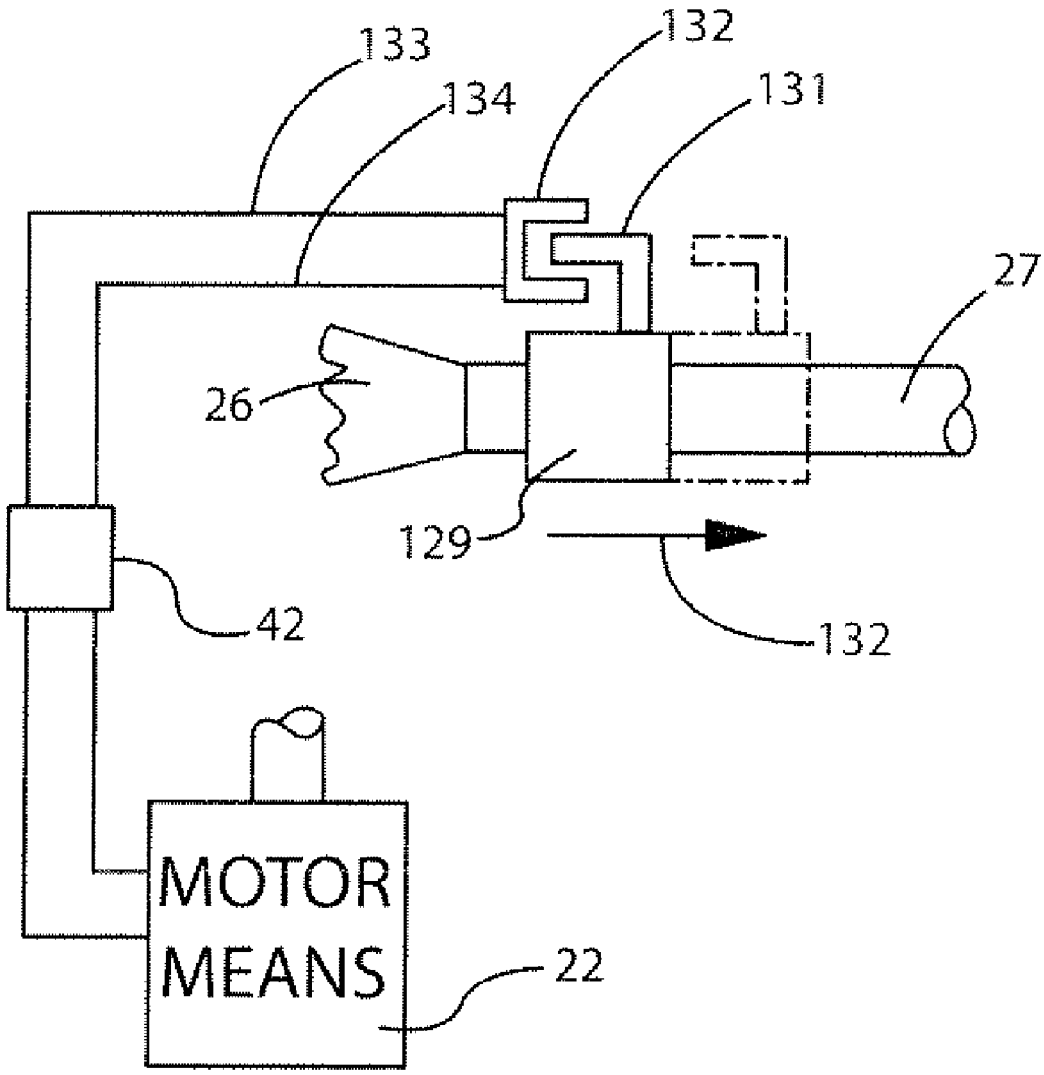
FIG. 9 is a schematic illustration of the magnetic switch shut-down mechanism for shutting down operation of the ice making operation, with the schematic illustration of FIG. 9 being taken generally from the zone IX of FIG. 1.

With reference now to FIG. 9, also, it will be seen that as the flag 131 is caused to move in the direction of the arrow 131, due to excessive build-up of ice in compression zone 127 causing coupling 128 to move from the full line position to the phantom line position therefore, the flag 31 that it carries will be moved from between poles of a magnetic switch 132, which will then open a circuit between electric control lines 133, 134, to shut down operation of the motor means 22. This operation in connection with the diverter valve system of this invention is used as an overload protection to safely shut down the ice making process as described above to prevent stalling of the gear motor 92, through the computer control 42.

In operation, the system in accordance with this invention operates as follows. The operator selects a priority container, which may, for example only, be ice receptacle 1 identified by the numeral 46. The operator, for example, will set a certain desired maximum and minimum ice level (with corresponding control differentials) within priority receptacle 46, which will be programmed into the computer 42, to be controlled by the sensor 51. The computer 42 will then monitor the ice level in that receptacle unit 46, until as ice is added to that receptacle unit, the level 52 thereof increases above the minimum set point level that has been programmed into the software of the computer 42, and when that occurs, the ice from the diverter valve system 41 will then be directed to fill ice receptacle unit 2, identified by numeral 45, which has its own programmed maximum level set point (and corresponding control differential), for example 48, so that when that level 48 is reached, the computer can re-direct ice back to priority ice receptacle unit 46 to complete the ice fill to the maximum level set point. A withdrawal of ice from either receptacle unit will cause the diverter valve assembly to distribute ice among the two receptacles, while always maintaining at least the minimum level set point in priority receptacle unit 1. Reaching the programmed set point level while filling with ice will cause ice to be diverted away from the receptacle (or the flow stopped if both maximum set point levels are attained), while reaching the set point control differential level while removing ice from the receptacle will cause ice to be directed towards the receptacle to re-fill with ice. Thus, via the different pre-programmed set points for the ice receptacle units (a minimum and maximum set point for the priority 1 receptacle, and a maximum set point for the priority 2 receptacle) and their "differentials" which can be considered upper and lower ice "action" levels in the various ice receptacle units recognized by the sensors 47, 51, the diverter valve assembly, operated by the computer 42 can divert ice from one ice receptacle unit to another, automatically. Such insures that a minimum level of ice in the priority receptacle, while evenly distributing ice to any given receptacle unit. It will be understood that the control provided via the computer 42 can be either analog or digital, as can be the sensors 51 and 47 that detect the upper and lower levels within any given ice receptacle unit.

It will thus be understood that a set point differential represents some predetermined deviation from the set point (either a maximum or minimum level being the set point) prior to action being taken by the computer controlled diverter valve redirecting the flow of ice to another receptacle. This is so that a dampening effect is achieved to prevent the diverter valve from diverting ice from one receptacle to another as soon as any unreasonably small change occurs in that level. Thus, for example, in the case of receptacle unit 1, when a minimum ice level is reached in that receptacle unit and ice is diverted to the second ice receptacle unit, it would not be desirable that the diverter valve almost immediately re-direct ice otherwise going to receptacle unit 2, to instead go to receptacle unit 1, when the withdrawal of ice from receptacle unit 1 has only dropped that level of ice in receptacle unit 1 perhaps ⅛ of an inch; rather, the pre-set differential for receptacle unit 1 may be set only to redirect the flow of ice otherwise going to receptacle unit 2, to instead go to receptacle unit 1 after the minimum level of ice in receptacle unit 1 has dropped, perhaps, 3 inches, or some other desired pre-set differential.

It will also be understood that an operator can re-set such levels and other control systems via the control panel 55, to change such levels for level control within the plurality of ice receptacle units, by changing the software that operates the computer 42, from the operator control panel 55.

It will be apparent from the foregoing that various modifications of the apparatus and system of this invention can occur, all within the spirit and scope of the invention as defined by the appended claims.

What is claimed is:

1. A diverter valve system for an ice making and delivery apparatus, for delivering ice to one of a pair of receptacle units, comprising:

(a) a conduit means for receiving ice; with the conduit means being connected to a discharge end of a rotating auger; with the rotating auger having a push surface for engaging ice and pushing the ice into and through the conduit means;

(b) a pair of ice receptacle units;

(c) a diverter valve connected to said conduit means, for receiving ice therefrom and diverting ice to one of first and second valve discharge lines;

(d) said first and second valve discharge lines being connected to said diverter valve and connected for delivering ice to respective corresponding first and second said ice receptacle units;

(e) activating means for activating said diverter valve to divert ice received from said conduit means from a first discharge line to a second discharge line; and (f) wherein the activating means includes force multiplication means including a motor and a motor driven crank and lever, each connected to a connecting rod, with the lever being connected to the diverter valve, and switch means for controlling the operation of the motor in response to a sensor sensing a predetermined level of ice build-up in a said unit.

2. The apparatus of claim 1, wherein the switch means comprises magnetic switches and a switch actuator plate, the switch actuator plate being carried by a shaft of said motor tear rotation therewith.

3. The apparatus of claim 1, wherein said switch means comprises means for controlling the operation of the motor at 180° sequences of rotation of the motor.

4. A diverter valve system accordingly to claim 1, wherein a substantially water-tight housing is provided for said diverter valve, with said housing comprising first and second housing parts connected together; with said conduit means disposed in said housing and connected to one end of the diverter valve in the housing; with one of said first and second diverter valve discharge lines being in communication with the other end of diverter valve depending upon the position of the diverter valve as determined by said actuation means, and with said diverter valve being pivotally mounted for rotation with said activation means, including means for activating said diverter valve from outside said housing.

5. The diverter valve system of claim 4, wherein said housing includes drain line means for drawing off melt water from ice in said housing.

6. The diverter valve system of claim 4, wherein the first and second housing parts are comprised of molded thermoplastic components, and said first and second housing parts are connected together along a parting plane.

7. A diverter valve system accordingly to claim 1 wherein the diverter valve is comprised of two molded thermoplastic components sealingly connected together along a parting line.

8. The diverter valve system of claim 7, pivotally mounted in a diverter valve housing.

9. The diverter valve system of claim 1, wherein the motor driven crank is arcuately movable and wherein the lever is angularly displaceable, and wherein the crank and lever are connected to opposite ends of the connecting rod.

* * * * *

UNITED STATES PATENT AND TRADEMARK OFFICE

CERTIFICATE OF CORRECTION

PATENT NO. : 7,757,500 B2
APPLICATION NO. : 11/750551
DATED : July 20, 2010
INVENTOR(S) : Richard B. Hawkes and Edward V. Twiggar, III It is certified that error appears in the above-identified patent and that said Letters Patent is hereby corrected as shown below:

Column 5, line 6 delete "scaled" and insert -- sealed --

Column 8, claim 2, line 4 delete "tear" and insert -- for --

Column 9, line 5 after "end of" insert -- the --

Signed and Sealed this

Twenty-sixth Day of October, 2010

David J. Kappos

David J. Kappos
*Director of the United States Patent and Trademark Office*